US005865254A

United States Patent [19]

Huber et al.

[11] Patent Number: 5,865,254

[45] Date of Patent: Feb. 2, 1999

[54] DOWNHOLE TUBING CONVEYED VALVE

[75] Inventors: Klaus B. Huber, Sugar Land; Laurent E. Muller, Stafford, both of Tex.

[73] Assignee: Schlumberger Technology Corporation, Sugar Land, Tex.

[21] Appl. No.: 791,583

[22] Filed: Jan. 31, 1997

[51] Int. Cl.[6] ..... E21B 34/06

[52] U.S. Cl. ..... 166/373; 166/126; 166/142; 166/150; 166/317; 166/318; 166/332.5

[58] Field of Search ..... 166/373, 126, 166/150, 142, 317, 318, 332.1, 332.5

[56] References Cited

U.S. PATENT DOCUMENTS

| | | | |
|---|---|---|---|
| 4,664,184 | 5/1987 | Grigar | 166/55.1 |
| 4,846,272 | 7/1989 | Leggett | 166/126 |
| 4,969,524 | 11/1990 | Whiteley | 166/51 X |

FOREIGN PATENT DOCUMENTS

| | | |
|---|---|---|
| 0 233 750 A2 | 8/1987 | European Pat. Off. . |
| 2 171 434 | 8/1986 | United Kingdom . |
| 9801377 | 3/1998 | United Kingdom . |

OTHER PUBLICATIONS

Owen Oil Tools product literature, Feb. 1995, Fort Worth, Texas (2 pages).

Schlumberger Perforating Services manual, 1993, Houston, Texas(5 pages).

Schlumberger RPPV Maintenance Manual, Mar. 1994, Rosharon, Texas (10 pages).

*Primary Examiner*—Roger Schoeppel

*Attorney, Agent, or Firm*—Gordon G. Waggett; John J. Ryberg; John Bouchard

[57] ABSTRACT

A downhole valve is disclosed for use in a tubing-conveyed string of tools in a well bore, constructed to be actuated to open under pressure forces by dropping a drop bar from the well surface through the tubing. The valve, deployed in the well in a closed condition, has a frangible member arranged to be broken by the drop bar to enable the valve to open. The valve opens under well pressure forces when well pressure exceeds tubing pressure, and opens under tubing pressure forces when tubing pressure exceeds or substantially equals well pressure. The valve is particularly useful when opened in conjunction with the detonation of a perforating gun for overbalanced or underbalanced well perforation. Methods of operating a string of tools including the valve are also disclosed.

14 Claims, 5 Drawing Sheets

DOWNHOLE TUBING CONVEYED VALVE

BACKGROUND OF THE INVENTION

In the process of completing an oil or gas well, it is common to lower tool strings into the well on long lengths of tubing. The tubing serves not only to support the weight of the string of tools in the well, but also to transmit pressure from the surface of the well for activating the tools to perform various functions, such as sealing the well bore or perforating the well casing for access to product-bearing deposits.

Downhole ballistic tools of such systems are typically detonated by an attached firing head which, in the case of tubing-conveyed systems, is either hydraulically activated from the surface of the well by pressure transmitted through the tubing, or by a weight, sometimes referred to as a drop bar, dropped down the tubing from the surface of the well.

In some instances a packer is set above the region of the well casing to be perforated prior to firing the perforating gun, sealing off the area within the well below the packer (sometimes called the "rat hole") from the upper well annulus.

When the rat hole is at an instantaneously lower pressure than the formation fluids just outside the casing at the depth and time of perforating, the well is said to be perforated in an "underbalanced" condition. This perforating condition is useful, for instance, to immediately extract perforation debris and other potentially well-plugging media from the vicinity of the perforation by a fast flow of formation fluids in through the freshly perforated casing holes.

Conversely, when the rat hole is at an instantaneously greater pressure than the formation fluids just outside the casing at the depth and time of perforating, the well is said to be perforated in an "overbalanced" condition. If the pressure differential is large enough, the process is referred to as "extreme overbalance" perforation, and is useful for forcing well fluids out into the formation through the freshly perforated casing at high velocities to clear product flow paths in the formation, or lengthen or create additional flow paths through the formation (a process commonly known as "fracturing"). On some occasions, extreme overbalance pressure differentials are practically limited to avoid detrimental pressure damage to the well casing.

The choice of whether or not to perforate a well in an underbalanced or overbalanced condition depends in large part upon known or assumed formation characteristics. Sometimes accurate measurements of formation characteristics are not available without lowering a tool string into the well.

SUMMARY OF THE INVENTION

We have realized that a valve constructed to open by downhole pressure, regardless of the relative magnitudes of tubing pressure and well pressure, will be useful for certain downhole operations, such as during underbalanced or overbalanced well perforation.

In one aspect of the invention a downhole valve for use in a tubing-conveyed string of tools in a well bore has a housing and a movable member. The housing defines a port for fluid communication between the tubing and the well bore. The movable member is arranged to block the port in a first position and to move upon actuation to a second position to expose the port. The movable member is constructed to be moved to the second position by downhole pressure while tubing pressure is greater than well pressure, while tubing pressure is less than well pressure, and while tubing pressure is equal to well pressure.

In some embodiments, the valve has a floating piston arranged to move within a piston chamber defined between the housing and the movable member. In the presently preferred embodiment, the movable member defines a tubing port between the piston chamber and the tubing, the housing defines a well port between the piston chamber and the well bore, and the piston is disposed between the tubing and well ports. Preferably the floating piston has at least one seal to block fluid flow between the tubing and well ports, the piston being constructed to move under well pressure forces, when well pressure is greater than tubing pressure, to move the movable member to the second position to expose the port.

A particularly useful embodiment of the valve is constructed to open within about one second after the passage of the drop bar under a pressure difference between tubing pressure and well pressure of at least 300 pounds per square inch (psi).

In some preferred embodiments a frangible member is arranged to be broken by a drop bar dropped from the surface of the well to actuate the valve. The frangible member is constructed to, in an unbroken condition, retain the movable member in the first position. In a broken condition, the frangible member enables the movable member to be moved to the second position.

In some embodiments, a chamber is defined between the housing and the movable member and contains a closed volume of fluid when the frangible member is in an unbroken condition. When the frangible member is in a broken condition, the chamber is arranged to be in fluid communication with the tubing. In the present configuration, the frangible member defines a cavity in hydraulic communication with the closed volume with the frangible member in an unbroken condition, and the cavity is arranged to be breached by the drop bar.

In some embodiments first and second sealed chambers are defined between the housing and the movable member. The first chamber contains a quantity of air and the second chamber contains a quantity of incompressible fluid. The movable member is constructed to be moved to the second position by downhole pressure to compress the air in the first chamber and expose the port.

In some embodiments the movable member comprises a sleeve arranged to move along its axis from the first position to the second position with the frangible member in a broken condition.

According to another aspect of the invention, a string of tools, to be lowered into a well on tubing, has the valve described above, arranged to be opened by a drop bar.

In some advantageous embodiments the string of tools also has a firing head constructed to be actuated by the drop bar, the valve being disposed above the firing head.

In some embodiments, a packer-setting tool is arranged between the tubing and the valve, and is constructed to deploy a packer to seal an annular space about the string of tools to define a rat hole beneath the packer. The valve is constructed to be opened by both rat hole pressure and tubing pressure.

According to another aspect of the invention, a method of opening a downhole valve in a well, comprises lowering into the well a valve having the housing, movable member and frangible member described above, and dropping a drop bar from the surface of the well to open the valve.

According to another aspect of the invention, a method of opening a downhole valve in a well in conjunction with the actuation of a drop bar activated firing head is provided. The method comprises lowering into the well a string of tools having both a firing head constructed to be actuated by a drop bar, and a valve disposed above the firing head, and dropping a drop bar from the surface of the well to open the valve and activate the firing head. The valve has the housing, movable member and frangible member described above.

According to another aspect of the invention, an improvement is provided in a downhole valve for use in a tubing-conveyed string of tools in a well bore. The valve comprises a housing defining a port for fluid communication between the tubing and the well bore, and a movable member arranged to block the port in a first position and to move upon actuation to a second position to expose the port. The improvement comprises constructing the valve to be moved to the second position by downhole pressure, regardless of the relative magnitudes of tubing pressure and well pressure.

A valve constructed according to the invention can advantageously be opened during either an underbalanced or overbalanced perforation, enabling the choice of perforation conditions to be made after the string of tools is in place in the well bore. Such increased flexibility is specifically advantageous when optimal well perforation conditions are unknown at the time of tool deployment. The properly timed opening of the valve improves, under some conditions, the effectiveness of overbalanced or underbalanced perforation to flush debris from the perforation zone or to stimulate and fracture the formation. Furthermore, because one valve is commonly configured for either perforation condition instead of having separate valve structures for different downhole pressure conditions, inventory costs can be reduced and tool string configurations simplified.

DESCRIPTION OF PREFERRED EMBODIMENTS

Figure 1:
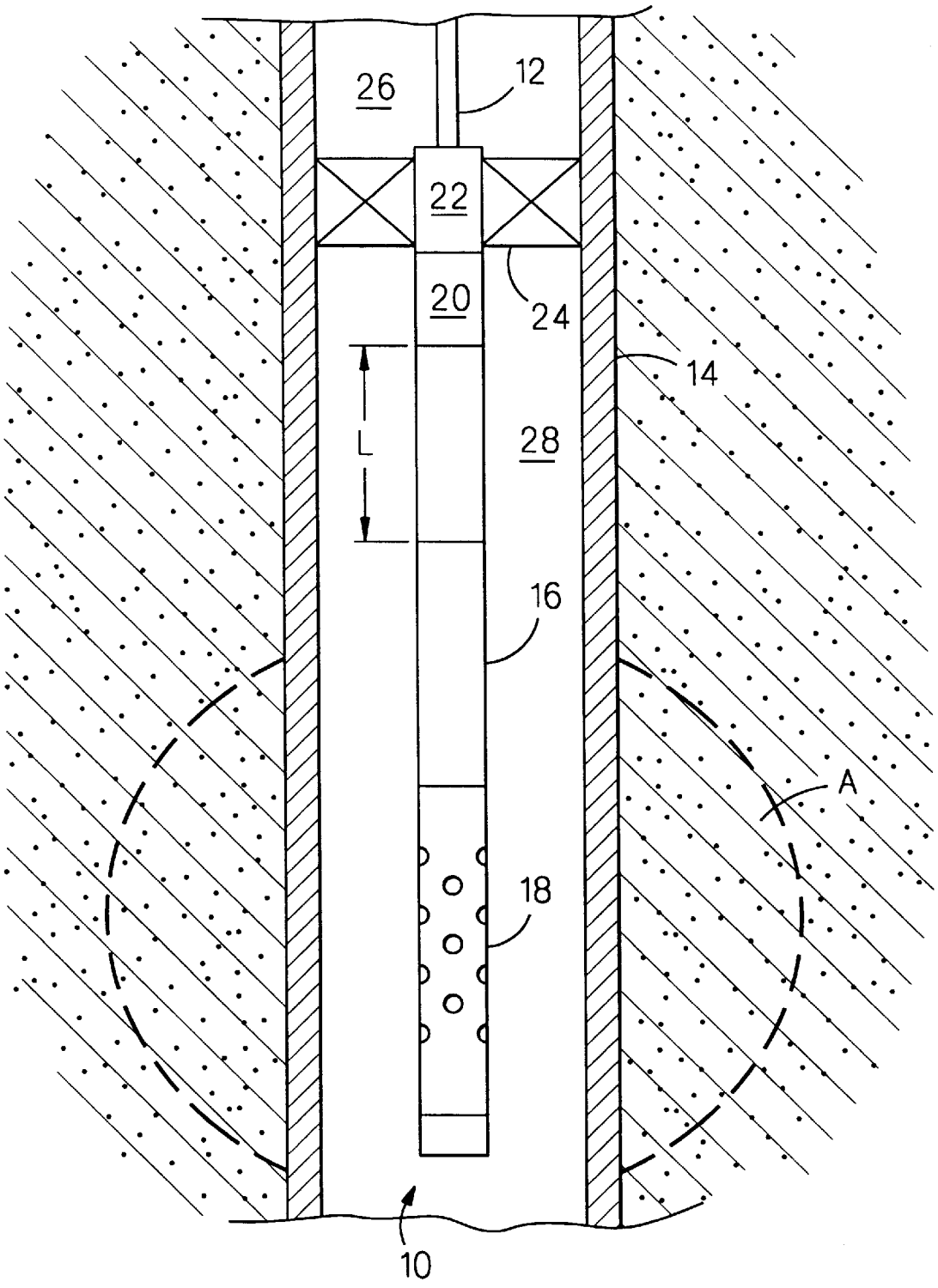
FIG. 1 illustrates a string of tools in a well bore, according to the invention.

Referring to FIG. 1, a string 10 of tools for performing downhole functions in a well is lowered on tubing 12 into well casing 14. In the illustrative embodiment shown, string 10 has a firing head 16 arranged to detonate a perforating gun 18. Disposed between firing head 16 and tubing 12 is a valve 20, according to the invention, constructed to control the flow of fluid between the inside of tubing 12 and the well. Valve 20 is normally in a closed condition as string 10 is lowered into the well. Above valve 20 is shown a packer-setting tool 22 for deploying a packer 24 to seal the well bore, defining a well annulus 26 above packer 24 and a rat hole 28 below the packer. In some embodiments, valve 20 and firing head 16 are separated by a length L.

Valve 20 is constructed to be opened by a drop bar released from the surface of the well and falling inside tubing 12. In a presently preferred embodiment, firing head 16 is constructed to be activated to detonate gun 18 in response to the same drop bar that opens valve 20, and length L is predetermined to provide a sufficient distance (e.g. about 30 feet) for the drop bar to regain sufficient speed after opening valve 20 to activate firing head 16. In some situations, e.g. when it is required to keep string 10 relatively short, valve 20 is attached directly to firing head 16 without a length L. In some embodiments, firing head 16 is activated by means other than a drop bar.

To perforate well casing 14 in an underbalanced condition, in operation the pressure inside tubing 12 (i.e. tubing pressure) is reduced to be substantially lower than well pressure (e.g. rat hole pressure) before opening valve 20. A difference between rat hole and tubing pressures of greater than about 300 psi, for instance, has been found to be suitable to open the valve at a desirable rate. Valve 20 is opened, preferably immediately before perforating gun 18 is detonated, to cause a sudden reduction in rat hole pressure and a corresponding flow of rat hole fluids into tubing 12 through valve 20, forcing formation fluids and debris immediately outside the casing in the perforation zone A into the well through the freshly-perforated casing, thereby flushing out both the perforation zone and casing holes.

To perforate well casing 14 in an extreme overbalanced condition, in operation the pressure inside tubing 12 is increased to be substantially greater than rat hole pressure (and formation pressure) before opening valve 20. Tubing pressure is increased, for instance, by applying pressurized nitrogen to the tubing at the well surface. When valve 20 is opened, again preferably immediately before perforating gun 18 is detonated, a sudden increase in rat hole pressure is caused, forcing rat hole fluids out through the freshly-perforated casing 14 and through the formation, fracturing and stimulating the formation for enhanced production.

The length L between valve 20 and firing head 16 is also predetermined for an optimal time delay between the opening of valve 20 and the firing of gun 18, preferably such that the opening and firing are quasi-simultaneous. When perforating in an underbalanced condition, for instance, opening the valve too early may cause formation fluids to flow into the rat hole from a lower perforated zone or casing joints, thus reducing the effective pressure difference between rat hole pressure and formation pressure at the instant of perforation. When perforating in an overbalanced condition, opening valve 20 too early can expose casing 14 to pressures which exceed its rated capacity, while opening valve 20 too late may decrease the effectiveness of the stimulation process. When exposed to a pressure difference of about 300 psi or more, valve 20 is constructed to open within about one second of the detonation of gun 18. Laboratory tests have demonstrated successful opening of the present embodiment of the valve at pressure differentials lower than 300 psi.

According to an important aspect of the invention, valve 20 is constructed to be opened by downhole pressure forces, regardless of the relative magnitudes of tubing pressure and well pressure.

Figure 2:
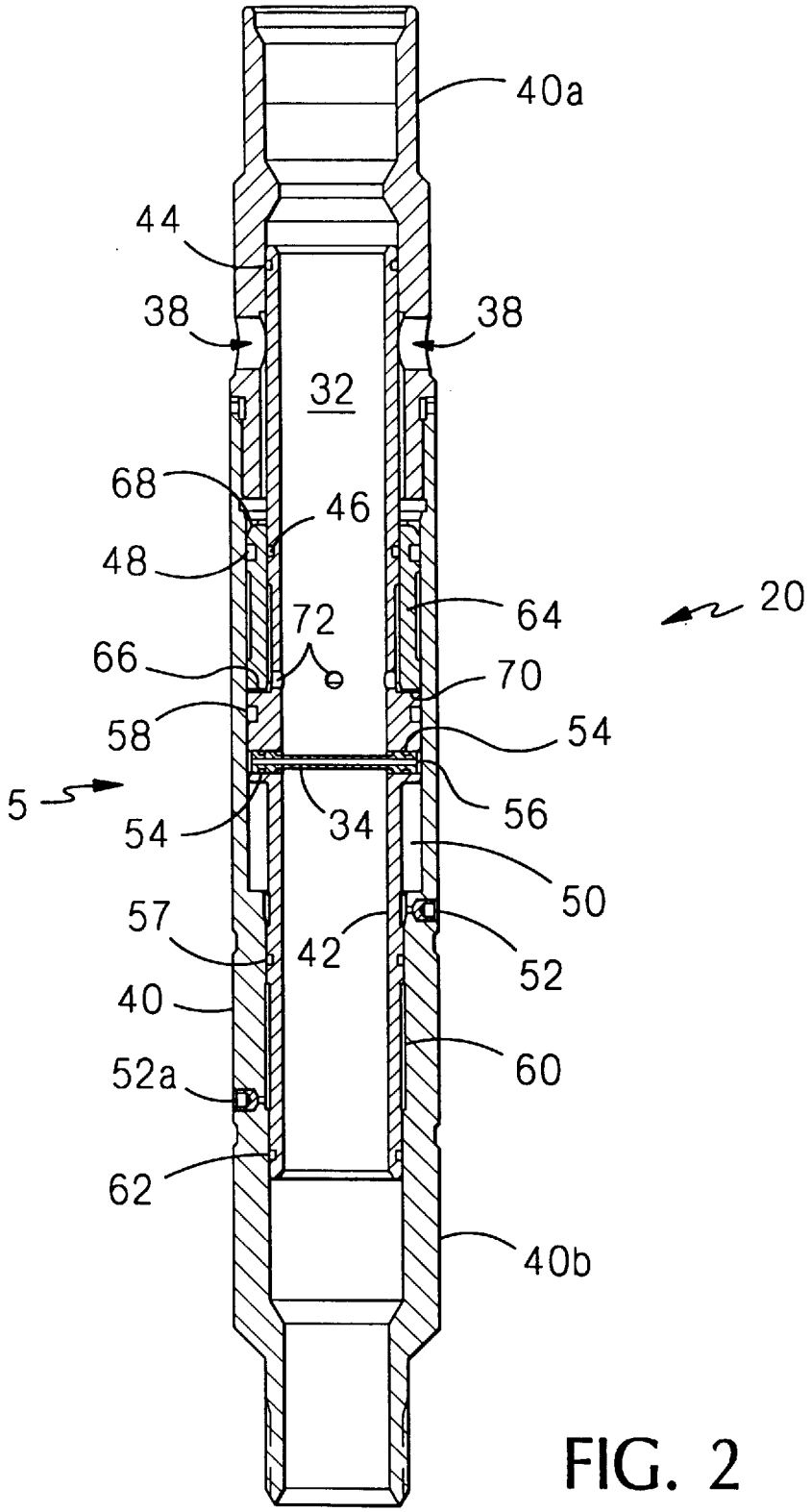
FIG. 2 is a cross-sectional view of the valve of FIG. 1.

FIG. 2 shows a presently preferred embodiment of the structure of valve 20. The housing 40 of the valve defines an interior passage 32 through the valve, and comprises an upper housing member 40*a* and a lower housing member 40*b*. In use in a tool string (e.g., as shown in FIG. 1), interior passage 32 of housing 40 of valve 20 is arranged to lie substantially along the axis of the tubing on which the tool string is lowered, such that a drop bar or other weight released to fall inside the tubing will pass through interior 32 of the valve. Upper housing 40*a* further defines ports 38 for flowing fluids between interior passage 32 and the exterior of the valve 20 with the valve 20 in an open condition. With valve 20 in a closed condition, as shown, a sleeve 42 is arranged to block (i.e. cover) ports 38 while o-ring seals 44, 46 and 48 resist leakage flow around sleeve 42. An annular oil chamber 50 is defined between sleeve 42 and lower housing 40*b* and prefilled with a low-compressibility fluid. A fill plug 52 plugs and seals a fill opening in lower housing 40*b* after chamber 50 has been filled. A hollow break plug 34 extends across interior 32 between openings 52 which adjoin chamber 50. O-ring seals 54 are arranged about each end of plug 34 to seal chamber 50 with break plug 34 in an unbroken condition, as shown. An interior cavity 56 within plug 34 is in hydraulic communication with chamber 50, thereby forming a portion of closed chamber 50 extending into interior 32 with plug 34 in an unbroken condition. O-ring seals 57 and 58 at each end of cavity 50 seal between housing 40 and sleeve 42. When break plug 34 is broken, the oil in chamber 50 flows out of the oil chamber into interior passage 32 as sleeve 42 moves to expose ports 38.

An annular air chamber 60 is also defined between lower housing 40*b* and sleeve 42, sealed by o-ring seals 57 and 62. A second fill plug 52*a* closes the air chamber after the valve has been preset. The arrangement of the two chambers 50 and 60 is such that moving sleeve 42 to expose ports 38 reduces the volume of each chamber.

A floating piston 64, with o-ring seal 48, is arranged to move within a bore of lower housing 40*b*, between upper housing 40*a* and a shoulder 66 of sleeve 42 within an annular piston chamber defined about sleeve 42 between upper housing 40*a* and sleeve 42. Rat hole pressure acts upon an upper surface 68 of piston 64 through ports 38. Tubing pressure acts upon a lower surface 70 of piston 64 as well as shoulder 66 of sleeve 42, through holes 72 in sleeve 42. Due to the operation of the opposing pressure forces, piston 64 moves downward to bear against shoulder 66 of sleeve 42 when rat hole pressure is greater than tubing pressure.

When break plug 34 has been broken, opening the previously closed oil chamber 50 to interior 32, sleeve 42 moves under pressure forces to collapse chambers 50 and 60 and expose ports 38. When well pressure is greater than tubing pressure (e.g. when performing an underbalanced perforation), floating piston 64 is pushed, under well pressure, to bear against shoulder 66 of sleeve 42 to move the sleeve to open ports 38. When tubing pressure is greater than well pressure (e.g. when performing an overbalanced perforation), sleeve 42 is pushed, under direct tubing pressure applied to shoulder 66, to move to open ports 38. When tubing pressure is substantially equal to well pressure, sleeve 42 is forced downward by tubing pressure acting upon shoulder 66, due to the difference between tubing pressure and the pressure in air cavity 60. In other words, valve 20 is constructed to open when exposed to any reasonable combination of downhole pressures (i.e. well pressure and tubing pressure) with break plug 34 in a broken condition.

Figure 3A:
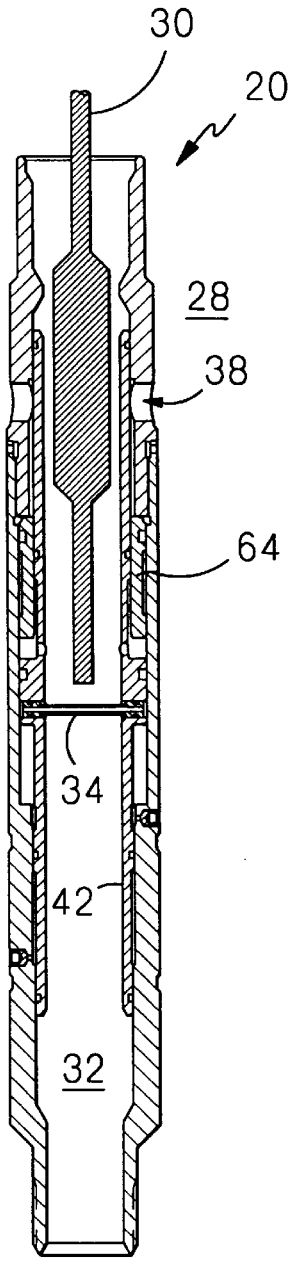
FIGS. 3A–3C sequentially show the opening of the valve when tubing pressure exceeds well pressure.
Figure 3B:
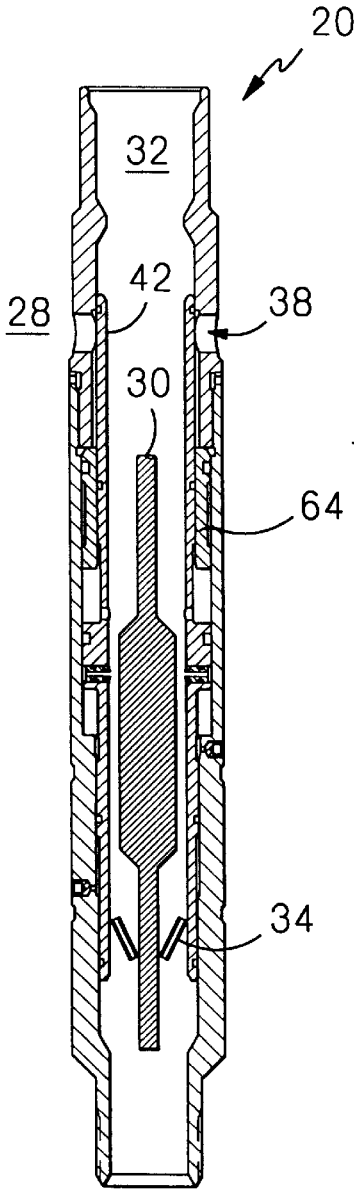
Figure 3C:
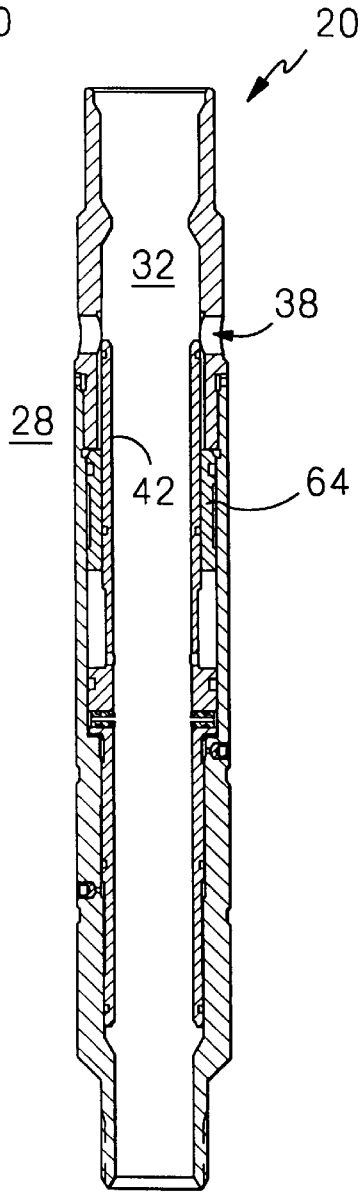
Figures 4A, 4B, 4C:
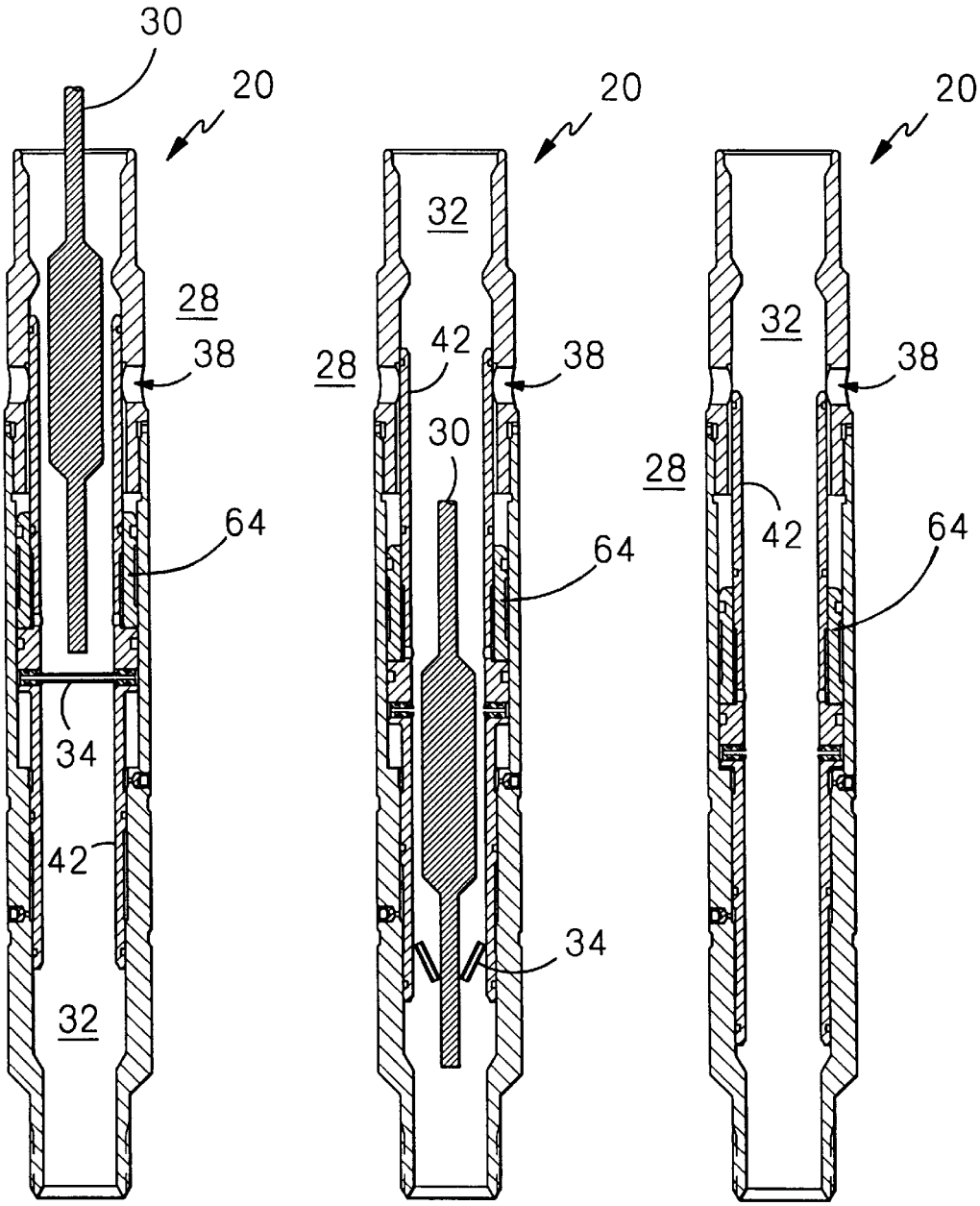
FIGS. 4A–4C sequentially show the opening of the valve when well pressure exceeds tubing pressure.

As illustrated by FIGS. 3A–3C and FIGS. 4A–4C, in operation a drop bar 30 is dropped from the surface of the well to open valve 20. Prior to the arrival of drop bar 30 at the valve, the valve is in a closed position as shown in FIGS. 3A and 4A, blocking fluids from flowing between the interior 32 of the valve, which is in fluid communication with tubing 12 (FIG. 1), and the rat hole 28. Break plug 34, which extends into interior 32, is in an unbroken condition until broken by drop bar 30. Drop bar 30 breaks break plug 34 (FIGS. 3B and 4B), enabling sleeve 42 to begin to move under pressure forces to expose ports 38 and open the valve. When tubing pressure exceeds or substantially equals well pressure, as in FIG. 3B, sleeve 42 moves downward under tubing pressure while piston 64 is pushed upward against the housing. When well pressure exceeds tubing pressure, as in FIG. 4B, piston 64 is pushed downward under well pressure to force sleeve 42 downward. Under all illustrated pressure conditions, sleeve 42 moves downward to expose ports 38 (FIGS. 3C and 4C).

Figure 5:
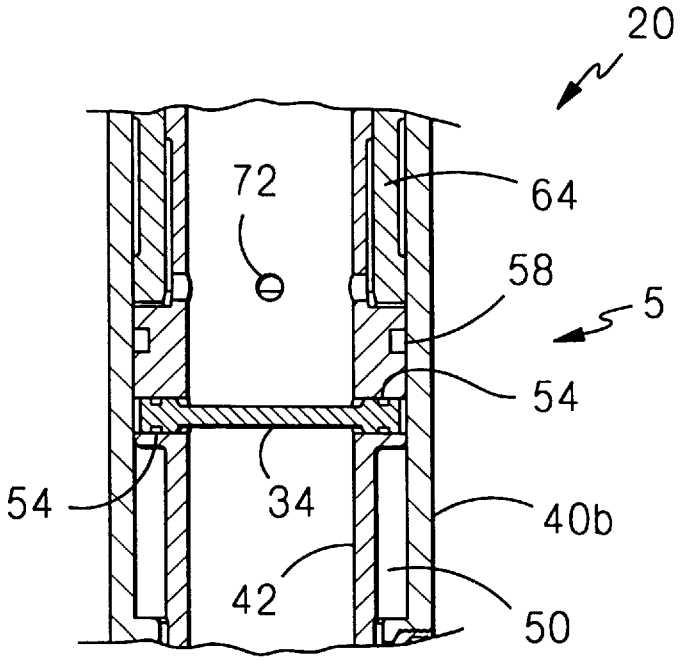
FIG. 5 is an enlarged view of an alternative embodiment of area 5 of FIG. 2.

As shown in FIG. 5, in an alternative embodiment there is no cavity within break plug 34. The break plug fragments, after break plug 34 is broken by the drop bar, are pushed out of openings 52 by pressure applied to chamber 50 by the downward motion of sleeve 42.

Other embodiments and advantages will be recognized by those skilled in the art, and are within the scope of the following claims. For instance, valve 20 is useful in other embodiments as a drop bar actuated downhole valve not associated with perforation, actuated to open under pressure forces in response to the dropping of a drop bar from the surface of the well.

What is claimed is:

1. A downhole valve for use in a string of tools conveyed on tubing under internal tubing pressure in a well bore under well pressure, the valve comprising a housing defining a port for fluid communication between said tubing and the well bore, a movable member arranged to block said port in a first, closed position and to move, upon actuation of the valve, to a second, open position to expose said port, and a floating piston arranged to move within an annular piston chamber defined about said movable member between said housing and said movable member, and to bear against said movable member while well pressure is greater than tubing pressure, said movable member constructed to be moved to said second position by tubing pressure, in response to the actuation of the valve, while tubing pressure is greater than well pressure and while tubing pressure is equal to well pressure, said movable member further constructed to be moved to said second position, while tubing pressure is less than well pressure and in response to the actuation of the valve, by force exerted by said floating piston.

2. The valve of claim 1 wherein said movable member defines a tubing port between said piston chamber and said tubing, said housing defining a well port between said piston chamber and the well bore, said piston being disposed between said tubing port and well port.

3. The valve of claim 2 wherein the floating piston comprises at least one seal to block fluid flow between said tubing and well ports, the piston being constructed to move under well pressure forces when well pressure is greater than tubing pressure, to move said movable member to said second position to expose said port.

4. The valve of claim 1 constructed to open within about 1 second after the valve is actuated, while exposed to a pressure difference between tubing pressure and well pressure of at least 300 psi.

5. The valve of claim 1 further comprising a frangible member arranged to be broken by a drop bar dropped from the surface of the well to actuate said valve, the frangible member being constructed to, in an unbroken condition, retain said movable member in said first position and, in a broken condition, to enable said movable member to be moved to said second position.

6. The valve of claim 5 further comprising a chamber defined between said housing and said movable member and containing a closed volume of fluid with said frangible member in an unbroken condition, said volume of fluid, with said frangible member in a broken condition, arranged to be in fluid communication with said tubing.

7. The valve of claim 6 wherein said frangible member defines a cavity in hydraulic communication with said closed volume with said frangible member in an unbroken condition, said cavity arranged to be breached by said drop bar.

8. The valve of claim 5 wherein said movable member comprises a sleeve arranged to move along its axis from said first position to said second position with said frangible member in a broken condition.

9. A string of tools to be lowered into a well on tubing, comprising the valve of claim 1 arranged to be opened by a drop bar.

10. The string of tools of claim 9 further comprising a firing head constructed to be actuated by said drop bar, the valve being disposed above the firing head.

11. The string of tools of claim 9 further comprising a packer setting tool arranged between the tubing and the valve and constructed to deploy a packer to seal an annular space about the string of tools to define a rat hole beneath the packer, the valve constructed to be opened by both rat hole pressure and tubing pressure.

12. The string of tools of claim 11 further comprising a firing head constructed to be actuated by said drop bar, the valve being disposed above the firing head.

13. A method of opening a downhole valve conveyed on tubing under internal tubing pressure in a well bore under well pressure, the method comprising lowering into the well a valve having a housing defining a port for fluid communication between said tubing and the well bore, a movable member arranged to block said port in a first, closed position and to move, upon actuation of the valve, to expose said port in a second, open position, a floating piston arranged to move within an annular piston chamber defined about said movable member between said housing and said movable member, and to bear against said movable member while well pressure is greater than tubing pressure, and a frangible member arranged to be broken by a drop bar dropped from the surface of the well to actuate said valve, the frangible member being constructed to, in an unbroken condition, retain said movable member in said first position and, in a broken condition, to enable said movable member to be moved to said second position, said movable member constructed to be moved to said second position by tubing pressure, in response to the actuation of the valve, while tubing pressure is greater than well pressure and while tubing pressure is equal to well pressure, said movable member further constructed to be moved to said second position, while tubing pressure is less than well pressure and in response to the actuation of the valve, by force exerted by said floating piston; and dropping the drop bar from the surface of the well to open the valve.

14. A method of opening a downhole valve in a well under well pressure, in conjunction with the actuation of a drop bar activated firing head, the method comprising lowering into the well, on tubing under internal tubing pressure, a string of tools having a firing head constructed to be actuated by a drop bar, and a valve disposed above said firing head, said valve having a housing defining a port for fluid communication between said tubing and the well bore, a movable member arranged to block said port in a first, closed position and to move, upon actuation of the valve, to expose said port in a second, open position, a floating piston arranged to move within an annular piston chamber defined about said movable member between said housing and said movable member, and to bear against said movable member while well pressure is greater than tubing pressure, and a frangible member arranged to be broken by a drop bar dropped from the surface of the well to actuate said valve, the frangible member being constructed to, in an unbroken condition, retain said movable member in said first position and, in a broken condition, to enable said movable member to be moved to said second position, said movable member constructed to be moved to said second position by tubing pressure, in response to the actuation of the valve, while tubing pressure is greater than well pressure and while tubing pressure is equal to well pressure, said movable member further constructed to be moved to said second position, while tubing pressure is less than well pressure and in response to the actuation of the valve, by force exerted by said floating piston; and dropping the drop bar from the surface of the well to open the valve and activate said firing head.

* * * * *